United States Patent [19]

Zimmermann et al.

[11] Patent Number: 4,725,188

[45] Date of Patent: Feb. 16, 1988

[54] FURNITURE IMPLEMENT FOR USE WITH A WHEELCHAIR

[76] Inventors: Donald L. Zimmermann, 17824 N. 45th Ave., Glendale, Ariz. 85308; George K. Wylie, 10216 N. 52nd Dr., Glendale, Ariz. 85302

[21] Appl. No.: 944,225

[22] Filed: Dec. 22, 1986

[51] Int. Cl.[4] ..... A61G 5/00

[52] U.S. Cl. ..... 414/678; 297/DIG. 4; 414/921

[58] Field of Search ..... 414/678, 921; 297/272, 297/310, DIG. 4; 280/289 WC

[56] References Cited

U.S. PATENT DOCUMENTS

| | | | |
|---|---|---|---|
| 2,567,672 | 9/1951 | Lawless | 414/678 |
| 3,306,660 | 2/1967 | Williams | 297/272 X |
| 3,476,404 | 11/1969 | Rachman | 414/640 X |
| 4,192,549 | 3/1980 | Petersen | 414/678 X |
| 4,527,944 | 7/1985 | Qually et al. | 414/678 |
| 4,561,823 | 12/1985 | Norton | 414/678 |
| 4,592,695 | 6/1986 | McConnell | 414/678 |

*Primary Examiner*—Leslie J. Paperner
*Attorney, Agent, or Firm*—James H. Phillips

[57] ABSTRACT

An article of furniture is provided for receiving a wheelchair and extending the wheelchair functions, the article of furniture including track rail members having upwardly opening concave tracks which extend rearwardly from a lowermost point to a first slightly raised position and then extend along curved paths in an arc having about the same or slightly larger radius of curvature as the large wheels of the wheelchair to be accommodated. Thus, a wheelchair may be backed along the concave tracks to "detent" over the first position to safely "bed" the wheelchair. Also included is a tilt frame against which the rear of the wheelchair bears and a head rest carried in an upper portion of the tilt frame. A controllable rearward reclining position may be assumed by actuating (alternatively, manually or power assisted) a lift mechanism which raises pads supporting the small front wheels of the wheelchair such that the entire wheelchair, as well as the tilt frame, rotates about the axis of the large wheels. When the desired reclining position is reached, the person in the wheelchair may rest at ease and in complete security-with his head against the headrest. The process is reversed when it is desired to remove the wheelchair from the assembly.

15 Claims, 9 Drawing Figures

FIG. 1
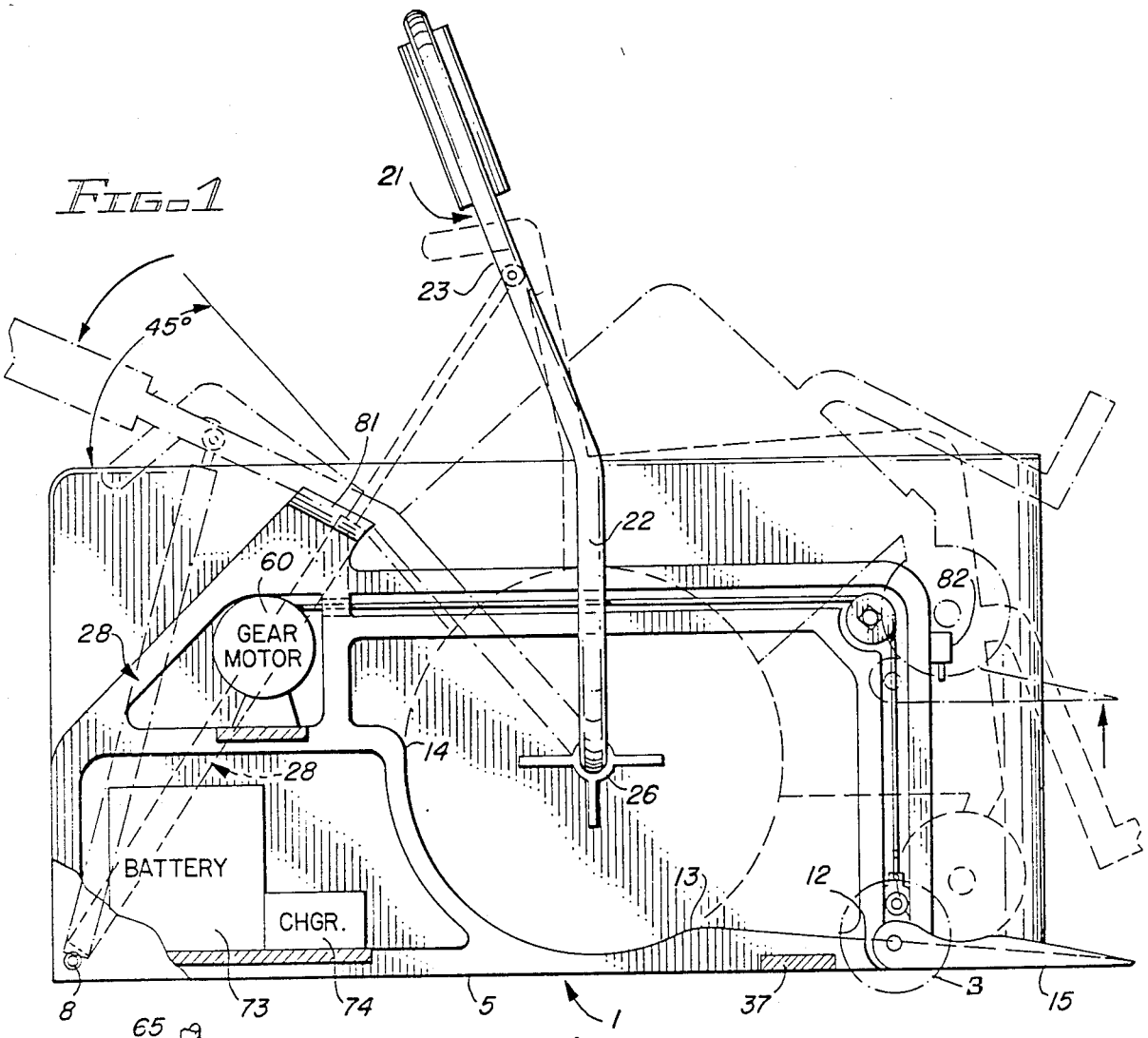
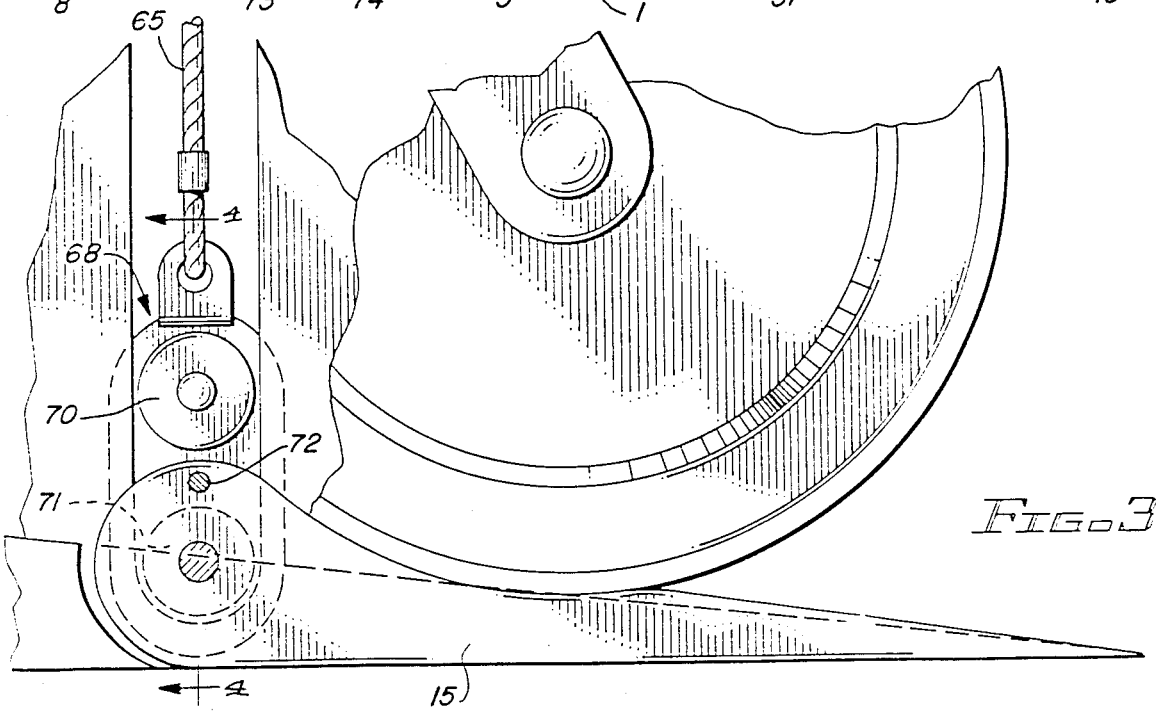
FIG. 3

FURNITURE IMPLEMENT FOR USE WITH A WHEELCHAIR

FIELD OF THE INVENTION

This invention relates to the art of special purpose implements for the physically handicapped and, more particular, to a furniture implement for use in conjunction with a wheelchair to cooperatively extend the range of the wheelchair's use.

BACKGROUND OF THE INVENTION

In recent years, there has been an increase in sensitivity toward physically handicapped persons who are wheelchair bound. As a result, there has been a widespread (albeit inadequate) improvement in the availability of facilities and features built into the public and private infrastructures which have contributed to the ability of wheelchair bound persons to enter a living in accordance with their mental talents and abilities and to simply interface more easily with the public as a whole in the work place and in general social intercourse. Nonetheless, a wheelchair bound person understands that he or she has special needs which simply do not occur to most ambulatory persons. One problem, notorious among wheelchair bound persons, is that of assuming a safe and comfortable resting position when there is no assistant at hand.

Consider, for example, the rather commonplace occasion in which a handicapped person is not feeling well and would like to recline into a position approaching the supine (or at least a position similar to that which can be assumed in a "recliner" chair). The handicapped person may have been at home or may have returned home from work or other outside activity; but, in any event, there is no assistant at the moment to lift the persom from the wheelchair and into bed or into a reclining chair. What is the handicapped person to do? He or she can only remain in the wheelchair and wait until an assistant does arrive. As wheelchair bound persons are most painfully aware, "dozing" in a wheelchair is difficult and uncomfortable and could even be dangerous for those who have limited neck strength.

We have directly addressed this problem, which is ubiquitous in the lives of wheelchair bound persons, and it is to its solution that our invention is directed. We have determined that certain therapeutic benefits also arise from the use of our invention. Among these therapeutic benefits are: improved circulation of blood in the legs and feet, relief of pressure on the thighs and buttocks, relief of pressure on the spine caused by sitting for many hours upright in a wheelchair, greater freedom to rest and nap at will and a distinct enhancement of the feeling and attitude of "independent living".

OBJECTS OF THE INVENTION

It is therefore a broad object of our invention to provide means for permitting an unaided wheelchair bound person to assume a restful position.

It is another object of our invention to provide, as an article of furniture, an implement with which a wheelchair can be coupled to increase the positional mobility of the wheelchair.

It is yet another object of our invention to provide such a furniture implement which will receive a wheelchair and, through the actuation of controls associated with the implement, permit the person seated in the wheelchair to cause the wheelchair to pivot about its large wheel axis to any position between upright and on the order of forty-five degrees recline.

In another aspect, it is an object of our invention to provide such a furniture implement which is safe and provides the user with a sense of stability and comfort as he reclines in the wheelchair/implement combination.

SUMMARY OF THE INVENTION

Briefly, these and other objects of our invention are achieved by providing an article of furniture for receiving a wheelchair and extending the wheelchair functions, the article of furniture including a wheelchair receiving assembly and left and right track rail members for which the distance between the rail members is adjustable to accommodate differing widths between the large wheels of a wheelchair. Each of the track rail members includes an upwardly opening concave track which extends from a lowermost point at its frontmost end to a first slightly raised position and then extends along a curved path rearwardly in an arc having about the same or slightly larger radius or curvature as the large wheels of the wheelchair to be accommodated. Thus, a wheelchair may be backed along the concave tracks to "detent" over the first position to safely "bed" the wheelchair in a position at which the large wheelchair wheels approximately match the curvature of the track rail member. Also included is a tilt frame against which the rear of the wheelchair bears and a head rest carried in an upper portion of the tilt frame. A controllable rearward reclining position may be assumed by actuating (alternatively, manually or power assisted) a lift mechanism which raises pads supporting the small front wheels of the wheelchair such that the entire wheelchair, as well as the tilt frame, rotates about the axis of the large wheels. When the desired reclining position is reached, the person in the wheelchair may rest at ease and in complete security with his head against the headrest. Several safety features are included in the mechanism incorporated into the furniture implement. Both mechanical and electrical stops are preferably included to redundantly assure that the angle of reclination does not exceed about forty-five degrees. Gas springs are preferably employed to store energy throughout the reclining operation in order to provide an uprighting force in the event of power failure or, particularly, to assist a manually operated embodiment of the implement.

DESCRIPTION OF THE DRAWING

The subject matter of the invention is particularly pointed out and distinctly claimed in the concluding portion of the specification. The invention, however, both as to organization and method of operation, may best be understood by reference to the following description taken in conjunction with the subjoined claims and the accompanying drawing of which:

FIG. 1 is partially broken away side view of a presently preferred embodiment of our invention illustrating the range of positions which may be established for a wheelchair emplaced therein and certain of the mechanical structure incorporated in our invention;

FIG. 3 is a broken away detail view from the region indicated at 3 in FIG. 1 illustrating an aspect of an exemplary lift mechanism which may be incorporated into our invention;

BRIEF DESCRIPTION OF THE INVENTION

Figure 2:
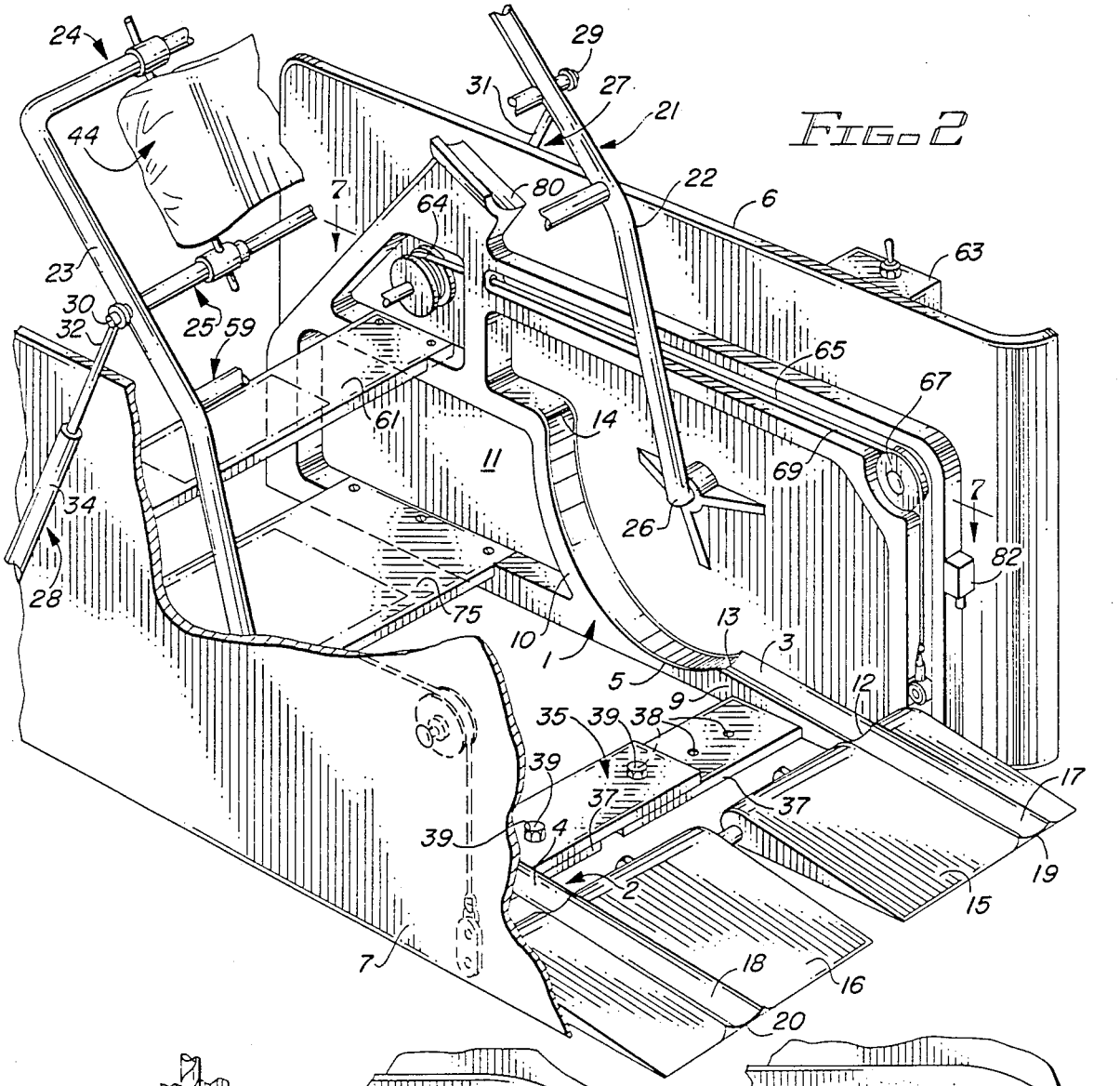
FIG. 2 is a partially cut away perspective view from the upper right of our invention and illustrates additional structure thereof which is out of view or not shown in FIG. 1.
Figure 4:
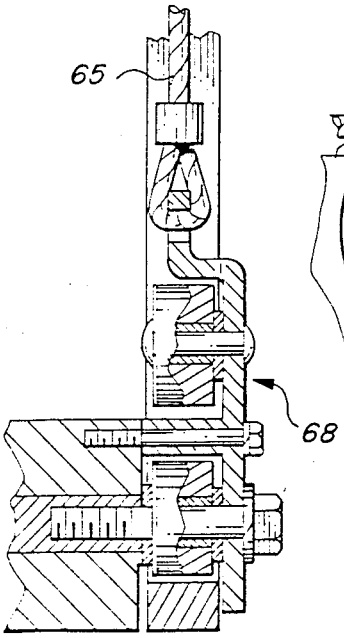
FIG. 4 is a partially broken away cross sectional view taken along the lines 4—4 of FIG. 3.
Figure 5:
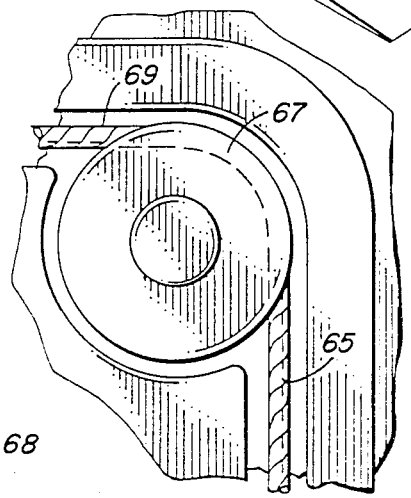
FIG. 5 is a broken away detail view of another aspect of an exemplary lift mechanism employed in our invention.

Attention is now directed to FIGS. 1 and 2, taken together, in order that the principal construction and operation features of a presently preferred embodiment of our invention can be explained. Because of the complexity and distribution of the various components of our invention, not all its structural details are shown in each view, and the reference numerals in the following passage may be therefore found in one or the other or both of FIGS. 1 and 2.

Thus, as shown in FIGS. 1 and 2, the presently preferred embodiment of our furniture wheelchair implement includes left 1 and right 2 track rail members. As best shown in FIG. 2, each track rail member 1, 2 includes an upwardly opening concave track 3, 4, respectively. The concave tracks 3, 4 are well adapted to receive the large wheels of a wheelchair backed into the furniture implement as will become more apparent from the discussion below. Referring in particular to the left track rail member 1 (the right track rail member 2 being generally out of view in FIG. 2 and simply a mirror image of the left track rail member 1) has a horizontal bottom 5 adapted to rest on the floor surface and a side panel 6. The right track rail member 2 correspondingly includes a side panel 7, and the side panels 6, 7 may be integral with or detachably mountable to the track rail members 1, 2.

The left track rail member 1 includes front 9, intermediate 10 and rear 11 sections. The upwardly opening concave track 3 extends continuously along upper surfaces of the front 9 and intermediate 10 sections of the left side track rail member 1. More particularly, the concave track 3 extends from a relatively low point at its frontmost end 12 and slopes slightly rearwardly upwardly to a first position 13 which is the junction between the front section 9 and the intermediate section 10 of the left track rail member. The concave track 3 further extends rearwardly along a curved path from the position 13 to a relatively high position 14 at which the rear section 11 of the left track rail member 1 commences. Between the points 13 and 14, the upwardly opening concave track 3 preferably follows a radius of curvature about the same as or slightly larger than that of the large wheels of the wheelchair with which it is to be used. It will be observed that the curvature immediately rearwardly from the point 13 slopes slightly downwardly such that the point 13 defines a slight peak which provides a detent-like action urging a wheelchair to bed in the intermediate section 10 as it is backed into the wheelchair receiving assembly as will be more fully described below.

Disposed at the foremost part of the furniture implement are left 15 and right 16 lift pads for receiving and supporting the small front wheels of a wheelchair which has been backed into the assembly. The lift pads 15, 16 are provided with upwardly opening concave track regions 17, 18, respectively, which are in alignment with and provide substantially the same shallow forward downward slope as the track portions in the front sections of the left and right track rail members. Thus, as best shown in the illustration of the left track rail member 1 in FIG. 2, the slope of the upwardly opening concave track 3 in the region between the points 12 and 13 is effectively continued forwardly along the upwardly opening concave track portion 17 to its frontmost point 19 which is only incrementally above the floor level. Similarly, the upwardly opening concave track portion 18 of the right lift pad 16 terminates in a forwardmost and lowermost point 20 to perform the corresponding function. Thus, it will be appreciated that the large wheels of a wheelchair may be backed up to the points 19, 20 and up the shallow inclines provided by the track portions 17, 18 and then onto the concave tracks 3, 4 and beyond the detent-like points (exemplified by the point 13) to positively bed the wheelchair with its large wheels securely situated in the intermediate sections of the left 1 and right 2 track rail members. When this position has been attained and as will be discussed more thoroughly below, the small wheels of the wheelchair will be situated at an intermediate position upon the upper surfaces of the left 15 and right 16 lift pads.

Figure 9:
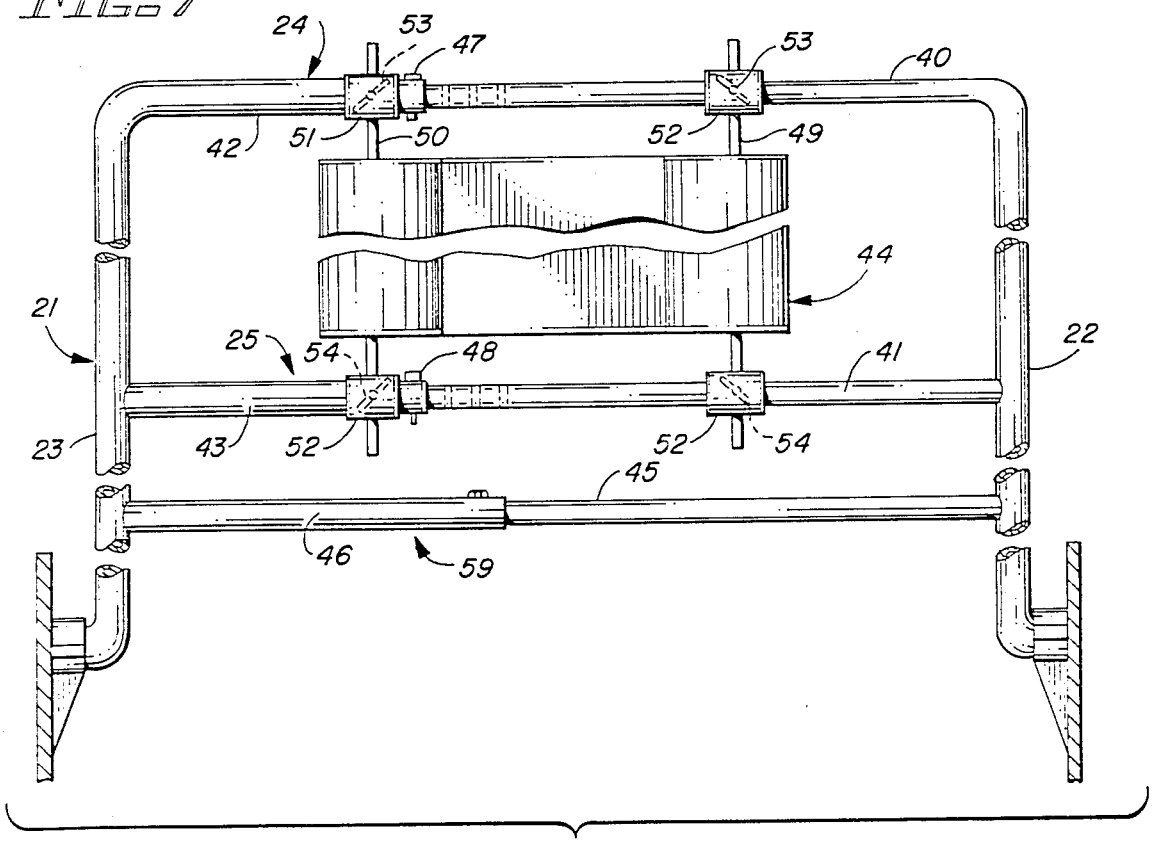
FIG. 9 is a collapsed view of a tilt frame which is a major component of our invention.

Referring to FIG. 9 as well as FIGS. 1 and 2, a tilt frame 21 has left 22 and right 23 spaced apart, generally downwardly depending legs and adjustable width upper and intermediate cross members 24, 25. The lower ends of the tilt frame legs 22, 23 are pivotally affixed, respectively, to side panels 6, 7 as illustrated in FIG. 2, for the left side of the assembly, at 26. Pivotal support 26, and the corresponding pivotal support (not shown) on the inside face of the right side panel 7 are preferably positioned in alignment with the axis of the large wheels of a wheelchair which may be situated within the wheelchair receiving assembly. Gas springs (or any other suitable compression springs or the functional equivalent) 27, 28 are affixed to the tilt frame 21 at intermediate positions 29, 30, respectively, and are also pivotally fixed, at their opposite ends, to the lower outer rear areas of the side panels 6, 7 as exemplified by the position 8, in view in FIG. 1, for the gas spring 28. Gas springs 27, 28 have respective plunger arms 31, 32 which telescope into housings (represented by the right side housing 34 in FIG. 2) to store potential energy as the tilt frame 21 pivots rearwardly. The potential energy stored in the gas springs 27, 28 is returned to the tilt frame 21 as it is brought back to its most nearly upright position to assist the motive means, whether manual or power assisted, as will be explained more fully below. While the gas springs 27, 28 are optional, it has been found that their inclusion in the assembly results in less strained operation of the wheelchair translating mechanism, particularly when it is manually actuated.

The entire furniture assembly is preferred (although not necessarily) adjustable to width in order to accommodate wheelchairs of correspondingly different widths; i.e., to insure that the concave tracks 3, 4, 17, 18 are in alignment with the large wheels of the wheelchair to be backed into the assembly. Thus at least two adjustable cross members, as represented by the cross member 35 in view in FIG. 2, extend between the left 1 and right 2 track rail members. The cross member 35 includes an upper member 36 and a pair of lower members 37 which extend inwardly from the respective left 1 and right 2 side rail members. The lower members 37 are contiguous with the bottoms of the track rail members 1, 2 and, when juxtaposed by the upper member 36 of the cross member 35, serve with the track rail members to support the entire assembly in a rigid and stable configuration. Pins (or bolts) 39 serve to establish the width between the track rail members 1, 2 by passing through apertures 38 distributed along the members 36, 37 to facilitate adjusting the width between the track well members 1, 2 to standard or non-standard wheelchair dimensions.

The tilt frame 21 must be correspondingly adjustable to width. Referring particularly to FIG. 9, this adjustment may readily be provided by telescoping together separate sections of the upper 24 and intermediate 25 cross members. Thus, a smaller diameter section 40 of the upper cross member 24 telescopes into the larger diameter section 42. Similarly, the smaller diameter section 41 of the intermediate cross member 25 telescopes into the larger diameter section 43. The selected width may be maintained by pins 47, 48 which pass through aligned apertures (whose position is selected for accommodating various width wheelchairs) through cross member sections 40, 42, and 41, 43.

It will be appreciated by those skilled in the art that many wheelchairs fall into standard width dimensions; therefore, a somewhat simpler embodiment of our invention simply substitutes non-adjustable components for the corresponding adjustable components discussed above. Such a slightly simplified embodiment is particularly appropriate where the implement is intended for the dedicated use of a single individual.

Still referring to FIG. 9, a headrest 44 is situated in the region between the upper cross member 24 and the intermediate cross member 25 of the tilt frame 21. The headrest 44 may be supported in that position by any convenient method such as by vertical rods 49, 50 which pass through apertures (out of view in FIG. 9) provided in extensions from the backs of clamp members 51, 52. Thus, vertical adjustment may be achieved by loosening wing nuts (out of view in FIG. 9), positioning the head rest 44 as desired and retightening the wing nuts. Wing nuts 53, 54 control the securement of the clamp members 51, 52 to the cross members 24, 25 and therefore permit adjustment of the horizontal position of the head rest 44 and also accommodation to the width adjustment process.

The tilt frame 21 also includes an adjustable width lower cross member 59 comprising telescoping sections 45, 46 extending inwardly from the left 22 and right 23 legs respectively. The lower cross member 59 supports the upper rear framework of a wheelchair disposed in the assembly during the reclining process as will be discussed more fully below.

Figure 7:
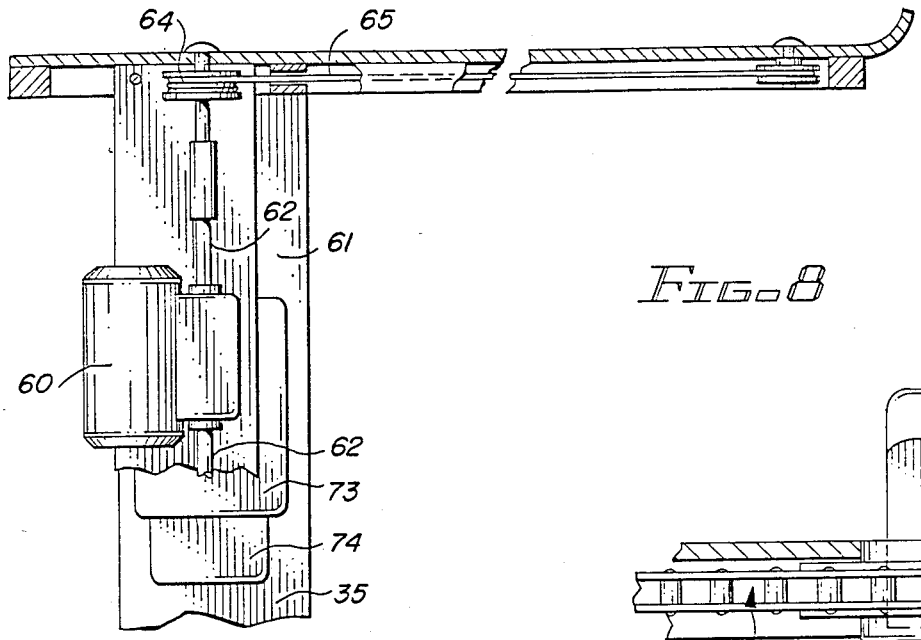
FIG. 7 is a fragmentary partially broken away view taken along the lines 7—7 of FIG. 2 illustrating the drive mechanism for a power assisted lift assembly embodiment of our invention.

When a wheelchair is situated within the wheelchair receiving assembly, it and its occupant may be tilted rearwardly to the desired angular position, and this function may be performed manually (as for those wheelchair occupants having adequately strong upper bodies and arms) or power assisted for less physically able individuals. Either of these configurations may be provided in a single example of the subject invention or both modes of operation may be made availabe in a single example. Considering first the motor assisted mode of operation and referring also to FIG. 7, it will be observed that a gear motor 60 is mounted on a platform 61 which extends between the track rail members 1, 2 in the region just below their upper rear sections. The gera motor 60 is adapted for low speed drive either electrically or mechanically and is provided with output shafts 62 extending toward both the left 1 and right 2 track rail members. (Alternatively, a pair of synchronized single shaft motors may be substituted to drive the left and right side lift mechanism, respectively.) Thus, the output shafts 62 revolve at a relatively slow rate when actuated, and in a selected direction according to conventional manipulation of a "joy stick" 63 (FIG. 2). Shafts 62 drive a pair of take-up/pay-out reels represented by the windlass 64 in view in FIG. 2.

In the immediately following discussion of the left side lift mechanism, it will be understood that corresponding components on the right side operate identically and in synchronism with the left side mechanism. The windlass 64 selectively reels in and pays out a cable 65 which extends forwardly to and across a pulley 67 and downwardly from the pulley to engage a lift fitting 68. Preferably, the cable 65, as well as the pulley 67 and the lift fitting 68, are all situated within slots 69 for both safety and to keep the assembly reasonably compact.

Operation of the entire lift mechanism may best be appreciated by simultaneously referring to FIGS. 1, 2, 3 and 4. When it is desired to pivot the tilt frame 21 rearwardly, the motor 60 is actuated to rotate in the direction which will take up the cable 65 on the windlass 64. Thus, the cable 65 moves rearwardly between the windlass 64 and the pulley 67 and upwardly between the pulley 67 and the lift fitting 68. It will be noted that the direction of travel in this last section of the cable run may be either vertical as shown or slightly tilted to the rear at the top. As the cable 65 pulls the lift fitting 68 upwardly, rollers 70, 71 raise the small wheel pad 15 along a linear path. The positions of the small wheel pad 15 is fixed with respect to the lift fitting 68 by pin 72 or any other appropriate means with the objective of maintaining the small wheel pad approximately horizontal during its traverse. The geometrical consequences of this arrangement will be discussed more fully below.

Thus, it will be appreciated that a wheelchair which has been emplaced in the implement may be made to tilt to any desired angle between approximately zero and forty-five degrees of appropriate manipulation of the joy stick 63. While the gear motor 60 may be of any appropriate type, it is presently preferred that it be reversible d-c powered in order that battery operation may be accommodated. Thus, it will be observed that a battery 73 and a battery charger 74 are supported on a lower platform 75, an arrangement which provides still further stability to the entire assembly by effecting a very low center of gravity. The principal advantages of using a d-c motor energized by a battery/charger unit are those of ease of control and reliability.

For example, a shunt wound d-c motor may have a constant voltage supplied to its field winding (when the unit is "on") with the energization to the armature winding and the polarity thereof being controlled by the joystick 63 which may therefore simply have "forward", "off" and "reverse" positions. As to reliability, consider that a situation to be avoided is one in which the wheelchair has been tilted to a rearward position, no attendant is at hand and the energization to the motor 60 is lost. This contingency is a very distinct possibility if the motor 60 is a-c powered because of the chance of simple failure of the mains. With a battery powered d-c motor, no such problem would arise since it is the battery 73 which directly energizes the motor 60, and an appropriate battery will have many cycles of reserve power permitting the use of the furniture implement even during periods of power outage and insuring automatic recharge when the mains are restored.

Figure 6:
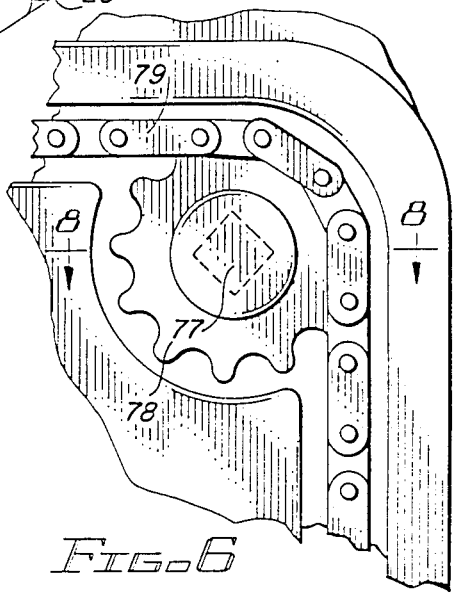
FIG. 6 is a variant of the view shown in FIG. 5 in which structural details have been adapted for manual, rather than power assisted, operation.
Figure 8:
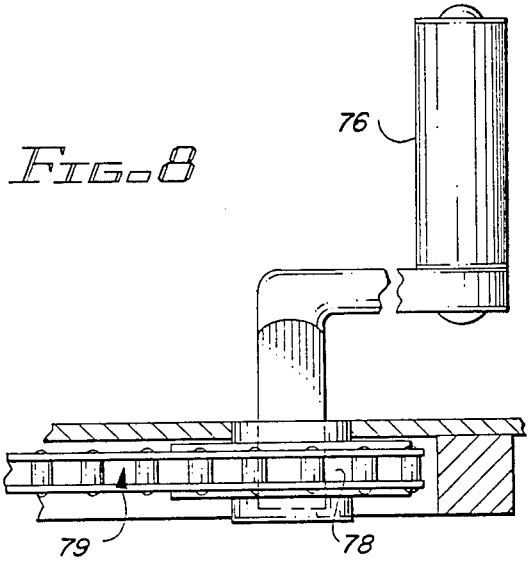
FIG. 8 is a fragmentary cross sectional view taken along the lines 8—8 of FIG. 6 and illustrates the adaptation of our invention to manual drive.

Consider now an important alternative manually driven embodiment of our invention. As shown in FIGS. 6 and 8, a handled crank 76 may be detachably inserted into a square aperture 77 centrally positioned in a cog wheel 78. The cog wheel 78 is substituted in place of the pulley 67 in the previously described power assisted embodiment. In place of the cable 65, a chain 79 is employed as the medium for transmitting power to the lift fitting 68. Thus, an individual with sufficient upper body and arm strength can operate the furniture implement manually by turning the crank 76 in the appropriate direction to correspondingly turn the cog wheel 78 and cause the traverse of the chain 79 to either raise or lower the lift fitting 68, the small wheel pads 15, 16 and hence the small wheels of the wheelchair situated within the assembly. In practice, of course, cranks would normally be employed simultaneously on both sides of the implement. For those embodiments employing both manual and power assisted operation, the latter can be conveniently adapted to actuate the chain 79 rather than the cable 65 for which the chain has been substituted. Alternatively, parallel systems may be employed.

FIG. 1 illustrates a wheelchair situated in the furniture implement in its fully upright position after it has been backed into the wheelchair receiving assembly and also illustrates, in phantom, a fully reclined position of the wheelchair at about a forty-five degree inclination. Of particular interest is the circular section path the small wheels follow during the tilting process. For most wheelchairs, they will be at their most forwardmost point on the lift pads 15, 16 about halfway through their total travel, but this forwardmost point is only about on the order of two inches or less from the small wheel's initial positions on the pads. Therefore, the simple vertical translation is entirely adequate, the small wheels first moving out a little on the pads 15, 16 and then back in as the axes of the small wheels continue to rise above the wheelchair pivot point which is the axis of the large wheels. If the structure of the wheelchair is such (e.g., relatively small large wheels) that there is substantially more travel of the small wheels above the axis of the large wheels than below that point in order to reach the full forty-five degrees of inclination, than the traverse of the lift pads 15, 16 may be revised to tend toward the rear as they rise to provide an appropriately compromised linear path.

While forty-five degrees is a substantial angle of inclination, the security provided by our implement promotes the confidence necessary in the user to take full advantage of its capabilities, and the therapeutic effects mentioned above are particularly evident at a relatively high degree of inclination. However, both for the user's sense of security and for actual safety, at least mechanical, and preferably (for the power assisted embodiment) also electrical, safety stops should be provided. Thus, the presently preferred embodiment of our implement includes mechanical stops 80, 81 which receive the left 22 and right 23 legs of the tilt frame 21 at just beyond the forty-five degree angle of inclination. For the power assisted embodiment, limit switch 82 is engaged by the left lift pad 15 (or repositioned to engage any other suitable component in the lift mechanism) just before the mechanical stops become effective to limit the power driven rearward tilt.

It will be appreciated that we have described the mechanical construction and operation of our implement without direct regard to its appearance. However those skilled in the art will understand that it can be upholstered or otherwise embellished to provide an article of furniture which is visually striking as well as capable of the full range of performance described above.

Thus, while the principles of our invention have now been made clear in an illustrative embodiment, there will be immediately obvious to those skilled in the art many modifications of structure, arrangements, proportions, the elements, materials, and components, used in the practice of the invention which are particularly adapted for specific environments and operating requirements without departing from those principles.

We claim:

1. An article of furniture for receiving a wheelchair and extending the functions thereof, said article of furniture comprising:

(A) a wheelchair receiving assembly including:
  1. left and right track rail members, each said track rail member having:
    a. a horizontal bottom for resting on a floor; and
    b. front, intermediate and rear sections; and
  2. first width determining means juxtaposing said left and right track rail members in generally parallel, spaced apart relationship;

(B) each said track rail member further including:
1. an upwardly opening concave track extending continuously along upper surfaces of said front and intermediate sections; said concave track:
    a. extending from a low point at its frontmost end in said front section to a first position at the junction of said front and intermediate sections; and
    b. further extending along a curved path rearwardly from said first position to a second position at the junction of said intermediate section with said rear section, said second position being situated higher than said first position;

(C) a tilt frame having upper, intermediate and lower portions;

(D) support means adapted to pivotally support said tilt frame within said receiving assembly such that said upper portion of said tilt frame is rotatable generally fore and aft with respect to said receiving assembly through an arc described about an axis positioned within said tilt frame lower portion; and (E) lift means adapted to:
  1. engage a wheelchair situated within said receiving assembly with its left and right large wheels respectively emplaced in said concave tracks in said intermediate sections of said left and right track rail members such that the axis of its large rear wheels are disposed generally parallel to said axis of rotation of said tilt frame; and
  2. raise a forward section of the wheelchair thereby causing the wheelchair to:

a. rotate about the axis of its large wheels; and
b. engage said tilt frame and cause it to rotate about its said axis to pivot said tilt frame upper portion generally rearwardly.

2. The article of furniture of claim 1 in which:
(A) said lower portion of said tilt frame comprises a pair of spaced apart, generally downwardly depending legs; and
(B) said tilt frame includes second width determining means for establishing the width between said tilt frame legs.

3. The article of furniture of claim 1 which further includes left and right side walls, said left and right side walls being generally vertically supported and respectively fixed to said left and right track rail members.

4. The article of furniture of claim 3 in which said support means for said tilt frame includes first and second pivots affixed, respectively, to said facing sides of said left and right side walls.

5. The article of furniture of claim 1 in which siad concave tracks each:
(A) first ascends gradually from said frontmost point rearwardly;
(B) reaches a slight peak at the junction between said front section and said intermediate section;
(C) descends gradually from said peak rearwardly; and
(D) joins said curved path at said first position.

6. The article of furniture of claim 1 in which said lift means includes:
(A) an upwardly movable pad adapted to engage a forward section of a wheelchair situated within said receiving assembly;
(B) at least one crank wheel situated for manual operation by a person seated in a wheelchair situated within said receiving assembly; and
(C) motion coupling means coupling said crank wheel to said movable pad whereby:
1. rotation of said crank wheel in a first direction raises said pad and the forward section of the wheelchair; and
2. rotation of said crank wheel in a second direction lowers said pad and the forward section of the wheelchair.

7. The article of furniture of claim 6 in which said lift means further includes mechanical energy storage and release means connected to said tilt frame, said mechanical energy storage and release means being adapted to store mechanical energy as said crank wheel is rotated in said first direction and to release mechanical energy as said crank wheel is rotated in said second direction.

8. The article of furniture of claim 7 in which said movable pad is disposed to rest beneath the small front wheels of a wheelchair situated within said receiving assembly.

9. The article of furniture of claim 8 which further includes a mechanical stop to limit the degree to which a wheelchair situated within said receiving assembly can be rotated about the axis of its large wheels.

10. The article of furniture of claim 1 in which said lift means includes:
(A) an upwardly movable pad adapted to engage a forward section of a wheelchair situated within said receiving assembly;
(B) an electric motor;
(C) an energy source for said motor;
(D) control means for controlling:
1. the energization of said motor; and
2. the direction of rotation of said motor when it is energized; and
(E) motion coupling means coupling said motor to said
movable pad whereby:
1. rotation of said motor in a first direction raises said pad and the forward section of the wheelchair; and
2. rotation of said motor in a second direction lowers said pad and the forward section of the wheelchair.

11. The article of furniture of claim 10 in which said lift means further includes mechanical energy storage and release means connected to said tilt frame, said mechanical energy storage and release means being adapted to store mechanical energy as said motor rotates in said first direction and to release mechanical energy as said motor rotates in said second direction.

12. The article of furniture of claim 11 which further includes rechargeable electrical energy storage means connected to said motor and said control means for selectively supplying power to said motor.

13. The article of furniture of claim 12 in which said movable pad is disposed to rest beneath the small front wheels of a wheelchair situated within said receiving assembly.

14. The article of furniture of claim 13 which further includes a mechanical stop to limit the degree to which a wheelchair situated within said receiving assembly can be rotated about the axis of its large wheels.

15. The article of furniture of claim 14 which further includes an electrical stop to limit the degree to which a wheelchair situated within said receiving assembly can be rotated about the axis of its large wheels.

* * * * *